US009295598B2

(12) United States Patent
Roussy et al.

(10) Patent No.: US 9,295,598 B2
(45) Date of Patent: Mar. 29, 2016

(54) PATIENT SUPPORT BACKREST RELEASE AND ACTUATOR ASSEMBLY

(75) Inventors: Richard B. Roussy, London (CA); Jason Connell, London (CA)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 13/316,066

(22) Filed: Dec. 9, 2011

(65) Prior Publication Data

US 2013/0145550 A1 Jun. 13, 2013

(51) Int. Cl.

| | |
|---|---|
| ***A61G 7/015*** | (2006.01) |
| ***A61G 7/018*** | (2006.01) |
| ***A61G 7/012*** | (2006.01) |
| ***A61G 7/07*** | (2006.01) |
| *A61G 7/05* | (2006.01) |

(52) U.S. Cl.

CPC ..... *A61G 7/015* (2013.01); *A61G 7/012* (2013.01); *A61G 7/018* (2013.01); *A61G 7/07* (2013.01); *A61G 2007/0509* (2013.01); *A61G 2007/0514* (2013.01); *A61G 2203/42* (2013.01); *A61G 2203/723* (2013.01); *A61G 2203/726* (2013.01); *Y10T 74/18056* (2015.01)

(58) Field of Classification Search

CPC ..... A61G 7/018; A61G 7/015; A61G 7/05; H02K 7/06; F16H 25/20

USPC ..... 5/613, 616, 617, 618, 424

See application file for complete search history.

(56) References Cited

U.S. PATENT DOCUMENTS

| | | | | |
|---|---|---|---|---|
| 3,877,088 | A * | 4/1975 | Bouman | 5/618 |
| 4,346,487 | A * | 8/1982 | Holdt et al. | 5/617 |
| 4,545,084 | A * | 10/1985 | Peterson | 5/618 |
| 4,559,655 | A | 12/1985 | Peck | |
| 4,709,790 | A * | 12/1987 | Freitag et al. | 188/300 |
| 4,885,948 | A * | 12/1989 | Thrasher et al. | 74/89.14 |
| 4,953,243 | A * | 9/1990 | Birkmann | 5/600 |
| 5,129,116 | A * | 7/1992 | Borders et al. | 5/617 |
| 5,325,551 | A | 7/1994 | Tappel et al. | |
| 5,329,657 | A * | 7/1994 | Bartley et al. | 5/617 |
| 5,423,097 | A | 6/1995 | Brule et al. | |
| 5,444,880 | A | 8/1995 | Weismiller et al. | |
| 5,542,136 | A | 8/1996 | Tappel | |
| 5,620,066 | A * | 4/1997 | Schuttler | 188/300 |
| 5,747,896 | A * | 5/1998 | Nagai et al. | 310/20 |
| 5,796,187 | A * | 8/1998 | Nagai et al. | 310/20 |
| 5,892,309 | A * | 4/1999 | Dreher | 310/80 |

(Continued)

FOREIGN PATENT DOCUMENTS

| | | | | |
|---|---|---|---|---|
| GB | 2071611 | A * | 9/1981 | B66F 1/02 |

*Primary Examiner* — David E Sosnowski

*Assistant Examiner* — Eric Kurilla

(74) *Attorney, Agent, or Firm* — Warner Norcross & Judd LLP

(57) ABSTRACT

A backrest of a bed is pivotable with respect to a bed frame. A backrest actuator assembly connects the backrest to the bed frame. The backrest actuator assembly is configured to raise and lower the backrest with respect to the bed frame by way of an actuator. The backrest actuator assembly is further configured with a lockable damper to release the backrest to lower due to gravity over a damped range of motion. The backrest can be so lowered during an emergency, such as an emergency that requires administration of CPR to the bed's occupant. The lockable damper can stop the lowering of the backrest at any position along the damped range of motion. After an emergency lowering, the backrest actuator assembly can automatically reset to a normal operation state.

23 Claims, 13 Drawing Sheets

(56) References Cited

U.S. PATENT DOCUMENTS

| | | | | |
|---|---|---|---|---|
| 6,000,076 | A * | 12/1999 | Webster et al. | 5/618 |
| 6,072,252 | A * | 6/2000 | Van Dine et al. | 310/43 |
| 6,112,867 | A * | 9/2000 | Mintgen et al. | 188/300 |
| 6,226,816 | B1 * | 5/2001 | Webster et al. | 5/618 |
| 6,296,089 | B1 * | 10/2001 | Koch et al. | 188/300 |
| 6,336,235 | B1 * | 1/2002 | Ruehl | 5/610 |
| 6,539,566 | B1 * | 4/2003 | Hayes | 5/618 |
| 6,586,854 | B1 * | 7/2003 | Nozawa et al. | 310/83 |
| 6,857,153 | B2 * | 2/2005 | Ruehl et al. | 5/600 |
| 7,055,195 | B2 | 6/2006 | Roussy | |
| 7,182,323 | B2 * | 2/2007 | Muller | 267/131 |
| 7,237,471 | B2 * | 7/2007 | Mintgen et al. | 91/422 |
| 7,296,312 | B2 * | 11/2007 | Menkedick et al. | 5/611 |
| 7,469,433 | B2 * | 12/2008 | Ruehl et al. | 5/617 |
| 7,472,439 | B2 | 1/2009 | Lemire et al. | |
| 7,568,247 | B2 * | 8/2009 | Strobel et al. | 5/613 |
| 7,594,450 | B2 * | 9/2009 | Wu et al. | 74/89.38 |
| 7,690,059 | B2 | 4/2010 | Lemire et al. | |
| 7,779,493 | B2 | 8/2010 | Lemire et al. | |
| 7,784,128 | B2 * | 8/2010 | Kramer | 5/624 |
| 7,805,784 | B2 | 10/2010 | Lemire et al. | |
| 7,836,531 | B2 * | 11/2010 | Girard et al. | 5/617 |
| 7,849,756 | B2 * | 12/2010 | Minnig et al. | 74/89.26 |
| 7,861,334 | B2 | 1/2011 | Lemire et al. | |
| 7,962,981 | B2 | 6/2011 | Lemire et al. | |
| 8,006,332 | B2 | 8/2011 | Lemire et al. | |
| 8,063,785 | B2 * | 11/2011 | Sacchetti | 340/573.7 |
| 8,393,026 | B2 | 3/2013 | Dionne et al. | |
| 8,544,126 | B2 | 10/2013 | Elliott et al. | |
| 8,674,572 | B2 * | 3/2014 | Dietrich | 310/83 |
| 8,689,376 | B2 | 4/2014 | Becker et al. | |
| 8,701,229 | B2 | 4/2014 | Lemire et al. | |
| 8,725,438 | B2 * | 5/2014 | Jensen | 702/60 |
| 8,844,076 | B2 | 9/2014 | Becker et al. | |
| 9,027,183 | B2 | 5/2015 | Childs et al. | |
| 9,038,217 | B2 | 5/2015 | Elliot et al. | |
| 2002/0059679 | A1 * | 5/2002 | Weismiller et al. | 5/610 |
| 2002/0066325 | A1 * | 6/2002 | Roither et al. | 74/89.23 |
| 2002/0083527 | A1 * | 7/2002 | Ruehl et al. | 5/600 |
| 2006/0243075 | A1 * | 11/2006 | Liou et al. | 74/89.39 |
| 2006/0277683 | A1 * | 12/2006 | Lamire et al. | 5/600 |
| 2006/0290038 | A1 * | 12/2006 | Knaust et al. | 267/136 |
| 2007/0144279 | A1 * | 6/2007 | Wu et al. | 74/22 A |
| 2007/0163043 | A1 * | 7/2007 | Lemire et al. | 5/600 |
| 2008/0211248 | A1 * | 9/2008 | Lambarth | 296/20 |
| 2008/0315728 | A1 * | 12/2008 | Liu et al. | 310/60 R |
| 2009/0133519 | A1 * | 5/2009 | Lorenzen | 74/89.32 |
| 2009/0256440 | A1 * | 10/2009 | Kragh et al. | 310/89 |
| 2010/0005590 | A1 * | 1/2010 | Jensen | 5/611 |
| 2010/0107790 | A1 * | 5/2010 | Yamaguchi | 74/89.38 |
| 2010/0139427 | A1 * | 6/2010 | Yamaguchi et al. | 74/89.33 |
| 2010/0176618 | A1 * | 7/2010 | Souke et al. | 296/20 |
| 2010/0225187 | A1 * | 9/2010 | Tseng | 310/83 |
| 2010/0225188 | A1 * | 9/2010 | Tseng | 310/83 |
| 2011/0043062 | A1 * | 2/2011 | Lorenzen | 310/83 |
| 2011/0180979 | A1 * | 7/2011 | Ishibashi et al. | 267/140.13 |
| 2011/0290057 | A1 * | 12/2011 | Corcoran | 74/473.12 |
| 2012/0102648 | A1 * | 5/2012 | Childs et al. | 5/611 |
| 2013/0147205 | A1 * | 6/2013 | Tucker et al. | 290/1 A |
| 2013/0285494 | A1 * | 10/2013 | Iversen et al. | 310/83 |
| 2013/0318720 | A1 * | 12/2013 | Connell et al. | 5/611 |

* cited by examiner

PATIENT SUPPORT BACKREST RELEASE AND ACTUATOR ASSEMBLY

FIELD

This disclosure relates to patient support devices, and more particularly, to an actuator assembly, a backrest actuator assembly, and a patient support device comprising a bed having same.

BACKGROUND

Patient support devices, such as beds used in hospitals and nursing homes, are often configurable into different positions. Many of such beds can be raised and lowered, as well as have backrests that can be tilted between a prone (sleeping) position and a raised (sitting) position. These positions are typically controlled by actuators, which are often electrically powered.

When a medical emergency occurs while a bed's backrest is raised, time can be wasted waiting for the actuator to lower the backrest into the prone position, which is often more amenable to administering emergency medical procedures, such as cardiopulmonary resuscitation (CPR).

In addition, when a bed's backrest is being lowered during an emergency, objects or a person's appendage can become lodged between the lowering backrest and the bed frame. This may lead to damage of the bed or human injury.

SUMMARY

A bed or other patient support device includes a frame, a backrest pivotable with respect to the frame, and an actuator assembly.

The actuator assembly is configured to raise and lower the backrest with respect to the frame. The actuator assembly is further configured to release the backrest to lower due to gravity over a damped range of motion.

The actuator assembly can further be configured to stop the lowering of the backrest at any position along the damped range of motion.

The actuator assembly can include an actuator connected in series with a damper and locking structure to selectively prevent shortening or collapse of the damper. The locking structure can include a lockable damper.

The actuator assembly can be configured to provide damping over a range of motion when unlocked and configured to lock at a position on the range of motion.

BRIEF DESCRIPTION OF THE DRAWINGS

The drawings illustrate, by way of example only, embodiments of the present disclosure.

DETAILED DESCRIPTION

A bed is used to illustrate many of the examples described herein. However, other patient support devices, such as adjustable chairs, are also suitable for use with the examples. Moreover, the term "patient" is not intended to be limiting, and can be taken to apply to anyone, such as individuals undergoing long-term care, hospital patients, and nursing home residents, to name a few.

Figure 1:
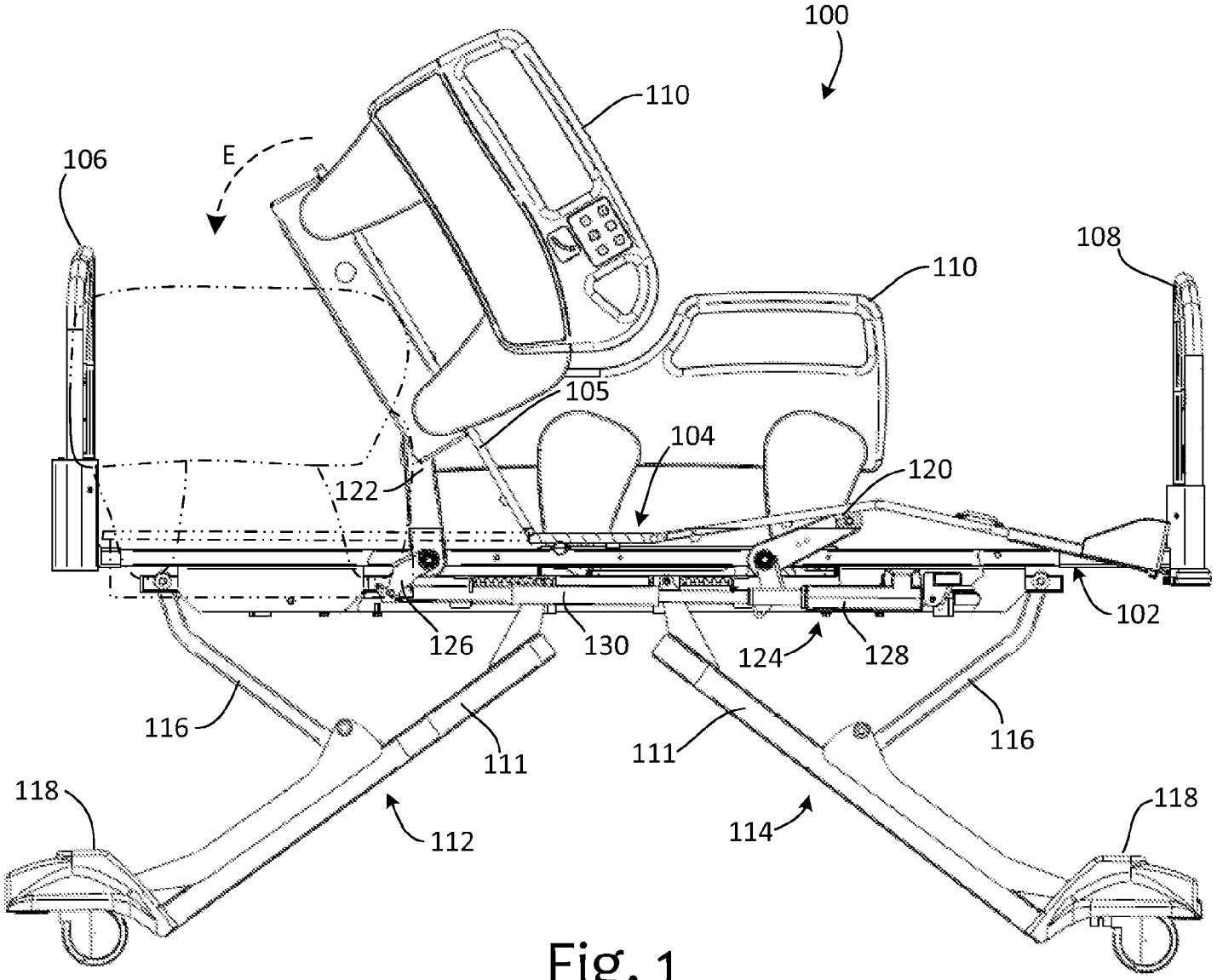
FIG. 1 is a side view of a bed having a backrest actuator assembly.

FIG. 1 illustrates an example of a bed 100. The bed 100 includes a substantially horizontal bed frame 102 with an adjustable mattress support 104 positioned thereon to receive a mattress (not shown) for supporting a person. In this example, the mattress support 104 has a backrest 105 capable of tilting up and down (raised position shown). At the head of the bed 100 is a headboard 106, while an footboard 108 is connected to the bed frame 102 at the foot end of the bed 100. One or more side rails 110 are positioned on each side of the bed 100. In this example, two side rails 110 are provided on each side of the bed 100, making four side rails in total. The two side rails 110 positioned at the head end of the bed 100 tilt with the backrest 105. Any of the side rails 110 may be moveable so as to facilitate entry and exit of a person.

The bed 100 includes two leg assemblies 112, 114, each having two legs 111. The head leg assembly 112 is connected at the head of the bed 100 and the foot leg assembly 114 is connected at the foot of the bed 100. Upper portions of the legs 111 of the leg assemblies 112, 114 are connected to one or more linear actuators (not shown) that can move the upper portions of the legs 111 back and forth along the length of the bed 100. Leg braces 116 pivotably connected to the legs 111 and to the bed frame 102 constrain the actuator movement applied to the legs 111 to move the leg assemblies 112, 114 in a manner that raises and lowers the bed frame 102. In other words, the leg assemblies 112, 114 are linkages that collapse and expand to respectively lower and raise the bed frame 102.

The lower ends of the leg assemblies 112, 114 are connected to caster assemblies 118 that allow the bed 100 to be wheeled to different locations.

The bed 100 further includes an attendant's control panel (not shown) at the footboard 108 that can, among other things, control the height of the bed frame 102 above the floor, as well as the tilt of the backrest 105 of the mattress support 104. The bed 100 further includes a controllable knee-height adjustment mechanism 120. To allow for similar adjustment, an occupant's control panel (not shown) can be provided, for example, on a side rail 110.

It should be emphasized that the bed 100 is merely one example of a bed that may be used with the example backrest actuator assemblies described herein. Other examples of beds that can be used include ultra-low type height-adjustable beds such as those disclosed in US Patent Publication No. 2011/113556 and U.S. Pat. No. 7,003,828, the entirety of both documents being included herein by reference.

As mentioned, the backrest 105 of the mattress support 104 is variably positionable, and accordingly can be raised and lowered so that the occupant of the bed 100 can be provided with, for example, a range of positions between fully prone and sitting upright. A backrest support 122 is pivotably connected to the bed frame 102 and supports the backrest 105 over its range of positions.

A backrest actuator assembly 124 is connected between the backrest 105 and the bed frame 102 and is configured to raise and lower the backrest 105 with respect to the bed frame 102. In this example, the backrest actuator assembly 124 includes an actuator 128 that is connected to the bed frame 102. The backrest actuator assembly 124 further includes a lockable damper 130 that is connected in series with the actuator 128 at one end and is pivotably connected to a lever arm 126 extending from the backrest support 122 at another end. The lever arm 126 may also be known as a head gatch bracket.

The actuator 128 can be an electric motor-driven linear actuator.

The lockable damper 130 can be a lockable fluid-filled damper, such as a locking hydraulic damper, locking gas spring, or the like. The lockable damper 130 is configured to provide damping over range of motion when unlocked and configured to rigidly or nearly rigidly lock at any position on the range of motion. For the linear style damper described herein, range of motion may be known as damper stroke. Generally, dampers may also be known as dampers or dashpots.

In one example, the lockable damper 130 includes a cylindrical body though which a piston slides. Each side of the piston has a chamber of fluid that is selectively communicated by pushing an unlocking pin that opens a valve in the piston to allow fluid to move between the chambers. Relative movement between the cylindrical body and a rod extending from the piston can then be damped (valve open) or held rigid (valve closed). In other examples, other kinds of dampers can be used. The lockable damper 130 can be a BLOC-O-LIFT™ device sold by Stabilus GmbH of Koblenz, Germany.

During normal operation of the bed 100, the lockable damper 130 is locked in an extended state and movement of the actuator 128 causes the lockable damper 130 to push or pull against the lever arm 126 to raise or lower the backrest 105 as commanded by the controller operated by the bed's occupant or an attendant, such as a nurse or caregiver.

The backrest actuator assembly 124 further includes a mechanical release (ref. 416 of FIG. 4) connected to the lockable damper 130. Components of the release may also be provided in the lockable damper 130. The release may be known as a cardiopulmonary resuscitation (CPR) quick release. The release is configured to unlock the lockable damper 130 when actuated to an unlock position, thereby allowing the damper 130 to contract without having to operate the actuator 128. During an emergency, such as a cardiac arrest of the bed's occupant, the release can be manually actuated to quickly allow the backrest 105 to lower due to gravity as shown by arrow E (lowered position shown in phantom line). The rate of lowering of the backrest 105 is controlled at least in part by the damping effect of the damper 130 as it contracts over its damped range of motion under the weight of the backrest 105, backrest support 122, attached side rails 110, mattress, the occupant's upper body, and any other items in or on the backrest 105.

After the CPR release has been actuated and while the backrest 105 is lowering due to gravity, the release can be manually returned to its original position, or lock position, to lock the lockable damper 130 at its current length and thereby stop the lowering of the backrest 105. The backrest 105 can be stopped at any position along the damped range of motion, which can make for safer bed operation. For example, if the arm of the occupant or that of a person standing near the bed becomes caught under the backrest 105 during a CPR release, the backrest 105 can be temporarily stopped to reduce the chance of injury.

Figure 2:
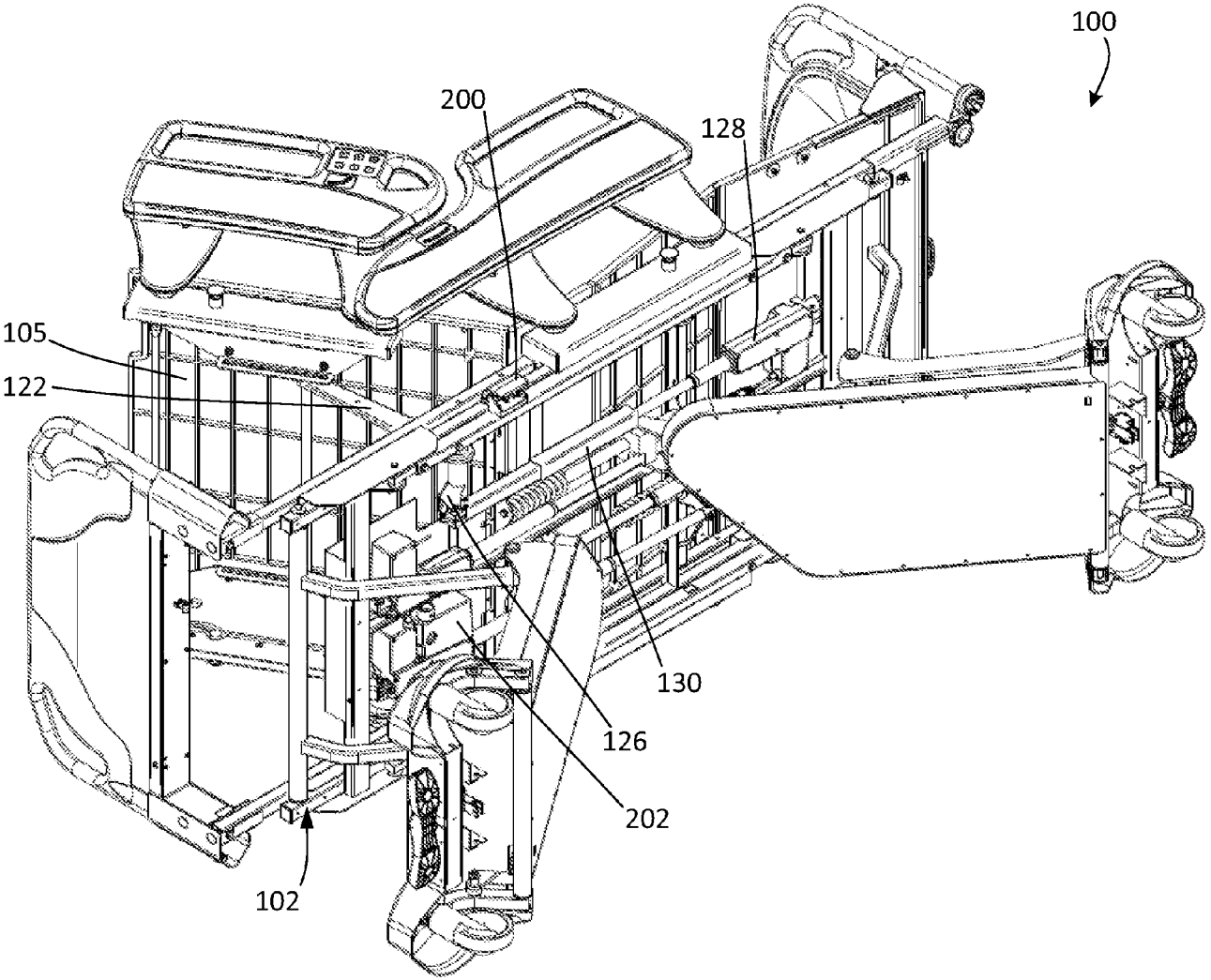
FIG. 2 is a perspective view of the bed, as viewed from below.

FIG. 2 shows the bed 100 from below. As can be seen, in this example, the release includes a manually actuated handle 200 attached to the bed frame 102. Each side of the bed frame 102 includes such a handle 200. In another example, one or both of the foot and the head of the bed frame 102 includes a handle 200.

In the view of FIG. 2, a housing of the lockable damper 130 is shown. Also shown is an actuator controller 202 that powers and controls the actuator 128, as well as other actuators used in the bed 100. The controller 202 can monitor the position of the actuator 128, via an actuator position transducer, such as a rotary pulse encoder located in the actuator housing (ref. 302 of FIG. 3). The controller 202 can also store preprogrammed positions for the actuator 128, such as a position that corresponds to the fully prone position of the backrest 105. The controller 202 is programmable to operate the actuator 128 according to a program, as will be discussed below.

Figure 3:
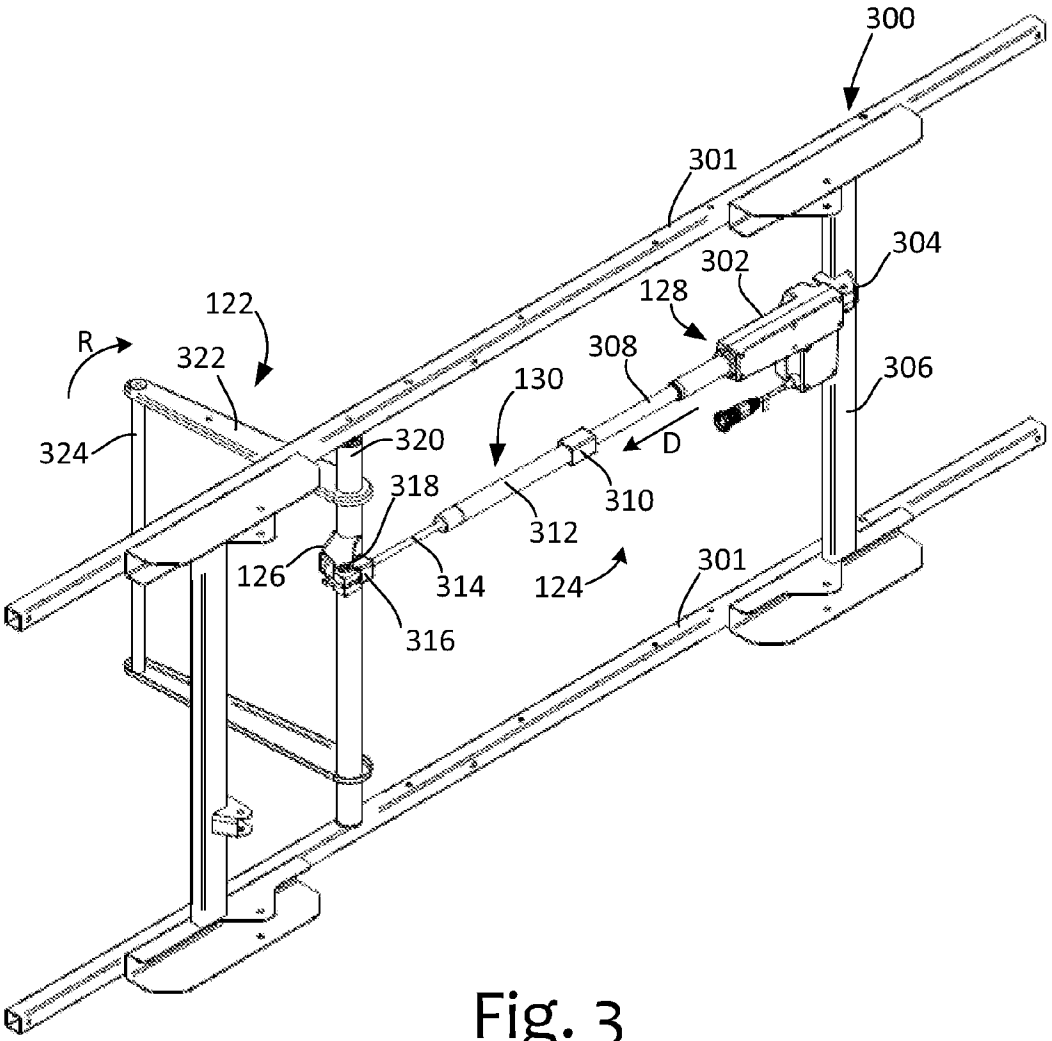
FIG. 3 is a perspective view of a portion of the bed frame carrying the backrest actuator assembly, as viewed from below.

FIG. 3 shows an upper (or live) portion 300 of the bed frame 102 that carries the actuator assembly 124. The upper portion 300 of the bed frame 102 includes two elongate rails 301 that run the length of the bed 100.

The housing 302 of the actuator 128 is pin-connected at 304 to a cross-member 306 that spans between the rails 301. Extending from the housing 302 is a driven rod 308 of the actuator 128 that is able to extend and retract by way of an electric motor and drive mechanism situated inside the housing 302.

A connector block 310 connects the rod 308 of the actuator 128 to a cylinder 312 of the lockable damper 130. The lockable damper 130 is shown with its housing removed for clarity, and the interaction between the connector block 310 and the housing of the damper 130 is discussed below.

A rod 314 extending from the cylinder 312 of the lockable damper 130 is connected to a release mechanism 316, which forms part of the release. As controlled by the release mechanism 316, the rod 314 can be locked rigid with respect to the cylinder 312 and unlocked to extend from and retract into cylinder 312 in a damped manner. The release mechanism 316 is pin connected at 318 to the lever arm 126 of the backrest support 122. The release mechanism 316 is connected to the handles 200, as will be discussed further.

The backrest support 122 includes a pivot member 320, such as a tube, that is rotatably connected between the rails 301 of the upper portion 300 of the bed frame 102. Support arms 322 extend from the pivot member 320 and have ends connected by a cross-brace 324.

As can be seen in FIG. 3, when the actuator rod 308 is extended in the direction D and the lockable damper 130 is locked, the backrest 122 is raised in the direction R by virtue of the lever arm 126. The opposite movement occurs when the actuator rod 308 is retracted. However, when the lockable damper 130 is unlocked, the backrest 122 is free to rotate opposite the direction R under the influence of gravity, with such rotation being limited by the damping effect of the damper 130.

Figure 4:
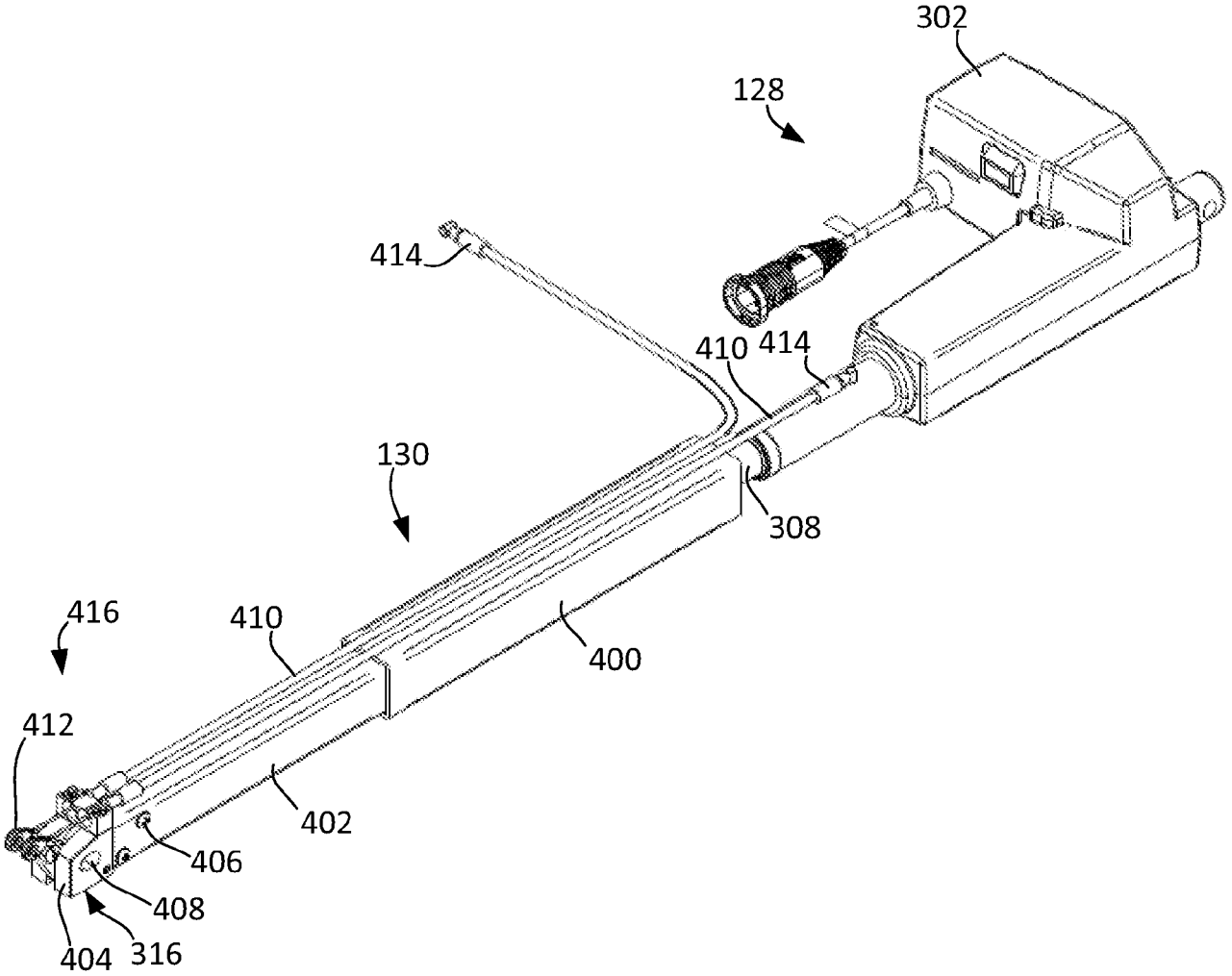
FIG. 4 is a perspective view of the backrest actuator assembly.

FIG. 4 shows the actuator assembly 124 as well as portions of the release 416.

A housing is formed of first and second housing pieces 400, 402 that cover the lockable damper 130 and provide support against bending or buckling of the lockable damper 130. In this example, the first and second housing pieces 400, 402 have rectangular cross-sections, are made of steel, and are welded together. The first housing piece 400 has inside dimensions that fit the rectangular outside dimensions of the connector block 310. Similarly, the second housing piece 402 has inside dimensions that fit the outside dimensions of a rectangular end of a bearing block 404 of the release mechanism 316 of the release 416. The second housing piece 402 and bearing block 404 are further held together by screws 406. In another example, a single housing piece can be used.

The release mechanism 316 is laterally pinned (see ref. 318 of FIG. 3) through a slot 408 to the lever arm 126 of the backrest support 122.

Two pull cables 410 are provided to the release 416, one for each handle 200 (see FIG. 2). Each pull cable 410 has an end 412 that connects to the release mechanism 316 and another end that has a fitting 414 for connecting to the handle 200. Each of the pull cables 410 is independently capable of actuating the release mechanism 316 in response to manual actuation of the connected handle 200. In this example, the pull cables 410 are also capable of providing a pushing force, and may be referred to as push/pull cables.

Figures 5, 6:
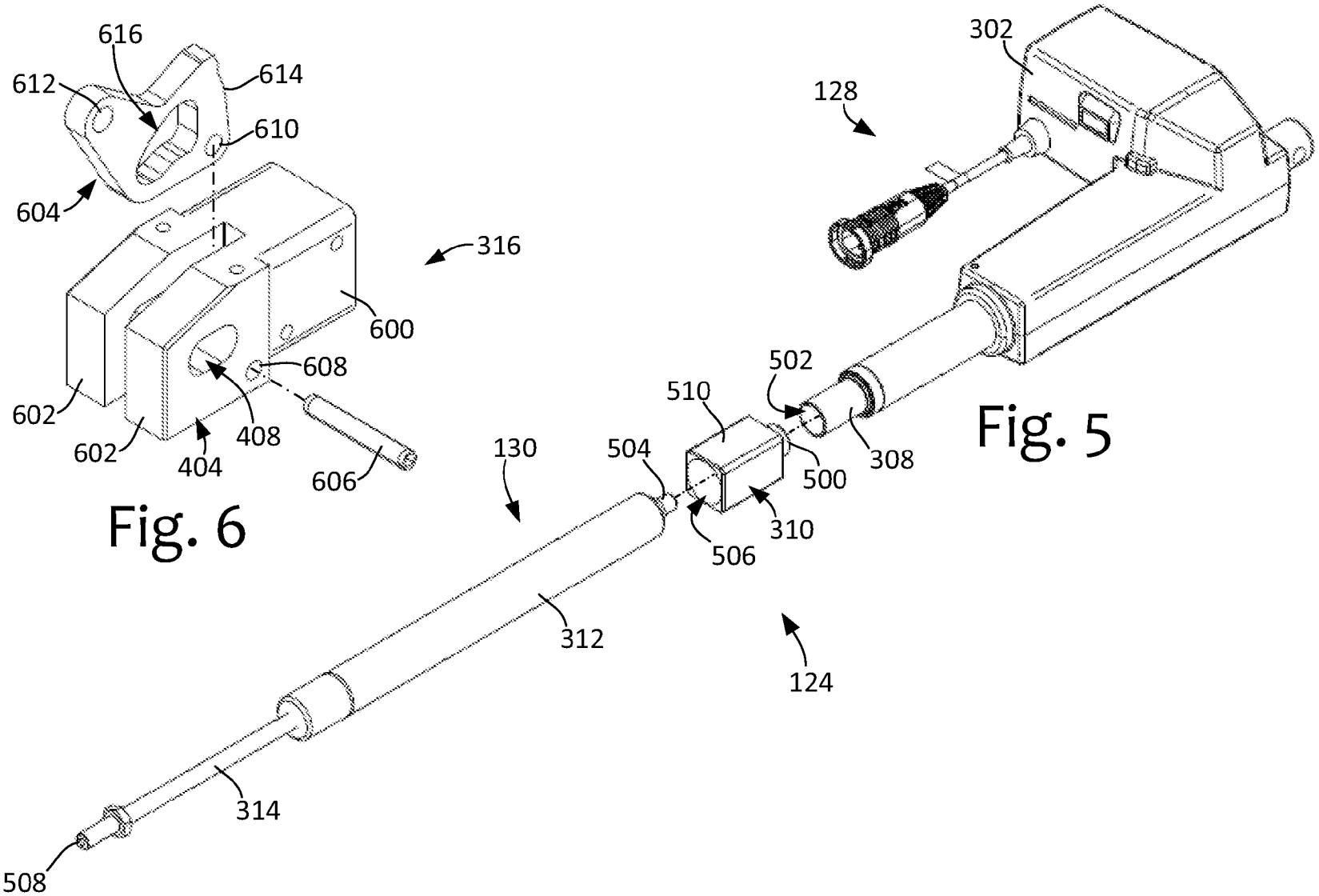
FIG. 5 is an exploded perspective view of the backrest actuator assembly with the housing of the lockable damper removed.
FIG. 6 is an exploded perspective view of the release mechanism.

FIG. 5 shows an exploded view of the actuator assembly 124 with the housing pieces 400, 402 of the lockable damper 130 removed.

The serial connection between the actuator 128 and the lockable damper 130 is shown in detail. A post 500 on connector block 310 is fixed into an opening 502 at the end of the actuator rod 308. The post 500 can be press fit into the opening 502 or threaded and locked into the opening 502. Any other kind of non-rotational connection can be used in other examples. A threaded stud 504 on the end of the damper cylinder 312 is threaded into a threaded hole (not shown) inside the connector block 310 when the base of the cylinder 312 is seated in an opening 506 of the connector block 310. Other connections of the cylinder 312 to the block 310 can be used in other examples.

As mentioned, the connector block 310 has a rectangular cross-section, of which an outside rectangular surface 510 forms a portion, for non-rotatably and slidably engaging with the inside of the housing piece 400. The connector block 310 holds the actuator rod 308 against rotation, while the housing pieces 400, 402 hold the connector block 310 against rotation. The lateral pin connection 318 of the bearing block 404 to the lever arm 126 of the backrest 105 holds the housing pieces 400, 402 against rotation. The connector block 310, however, is free to slide within the housing piece 400, and does so when the damper 130 contracts or extends. In other examples, the connector block 310 and the housing piece 400 can take other non-circular cross-sections for this purpose.

FIG. 5 also shows an end 508 of a pin (ref. 702 of FIG. 7*b*) that is pushed to unlock the damper 130. As discussed elsewhere herein, the pin extends inside the damper rod 314 and connects to a valve of a piston that is slidably disposed inside the cylinder 312.

FIG. 6 shows the release mechanism 316 in detail.

As mentioned, the bearing block 404 has a rectangular cross-section, of which an outside rectangular surface 600 forms a portion, for mating with the inside of the housing piece 402 in a non-rotatable manner.

Identical slots 408 in two parallel legs 602 of the bearing block 404 run parallel to the length of the damper 130 and actuator rod 308. The slots 408 accommodate a pin (ref. 700 of FIG. 7*b*) to form the pin connection 318 of the release mechanism 316 to the lever arm 126 of the backrest support 122. The pin may also be known as a head gatch shoulder screw. The legs 602 are separated by a space to accommodate a lever 604 positioned to engage the unlocking mechanism of the lockable damper 130.

A pin 606 inserted into holes 608, 610 on the bearing block 404 and lever 604 pivotably connects the lever 604 to the bearing block 404 and thus to the end of the actuator assembly 124. Another hole 612 is provided in the lever 604 at a distance removed from the pivot hole 610. The hole 612 is for receiving connection of the ends 412 of the pull cables 410 (see FIG. 4). The distance between the holes 612, 610 allows the pull cables 410 to pivot the lever 604 about the pin 606.

A contact surface 614 is provided on the lever 604 for contacting and pushing the end 508 (see FIG. 5) of the pin that unlocks the damper 130. The contact surface 614 can be contoured to transmit substantially only a normal pushing force to the end 508 of the pin irrespective of the rotational position of the lever 604.

The lever 604 also includes an opening 616 aligned with the slots 408. The opening 616 has a cam surface that is configured to engage the pin (ref. 700 of FIG. 7*b*) to rotate the lever 604, as will be discussed below.

FIGS. 7-10 show the bed 100 during operation.

Figure 7A:
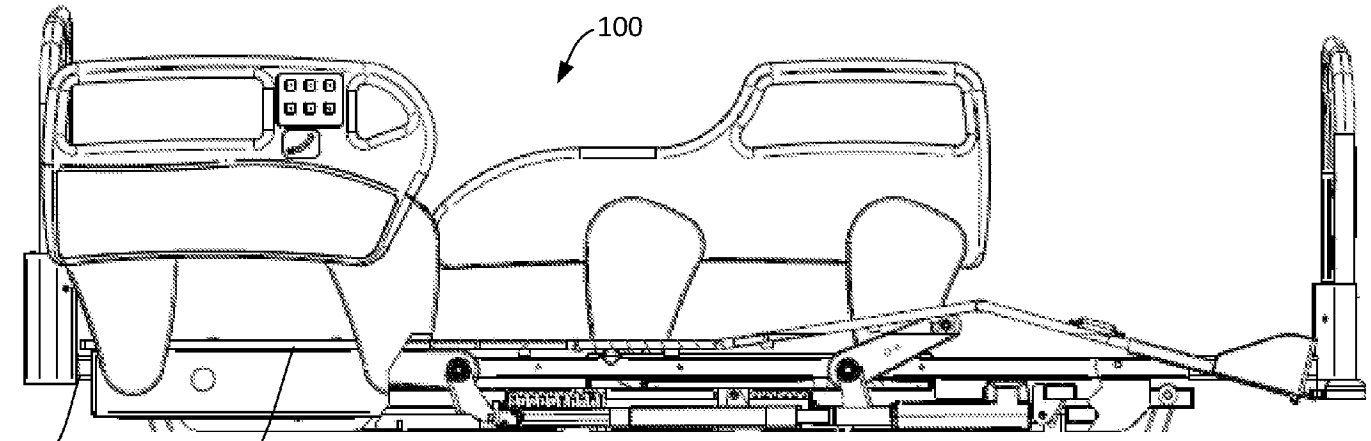
FIG. 7*a* is a side view of the bed when the backrest is in the fully prone position.

FIG. 7*a* shows the backrest 105 of the bed 100 in the fully prone position, which an occupant of the bed 100 may use to sleep. Some or all of the weight of the backrest 105 and the weight it supports rests on the frame 102 due to direct contact of the backrest 105 of backrest support 122 with the fame 102. The backrest actuator assembly 124 does not need to take any load in this position.

Figure 7B:
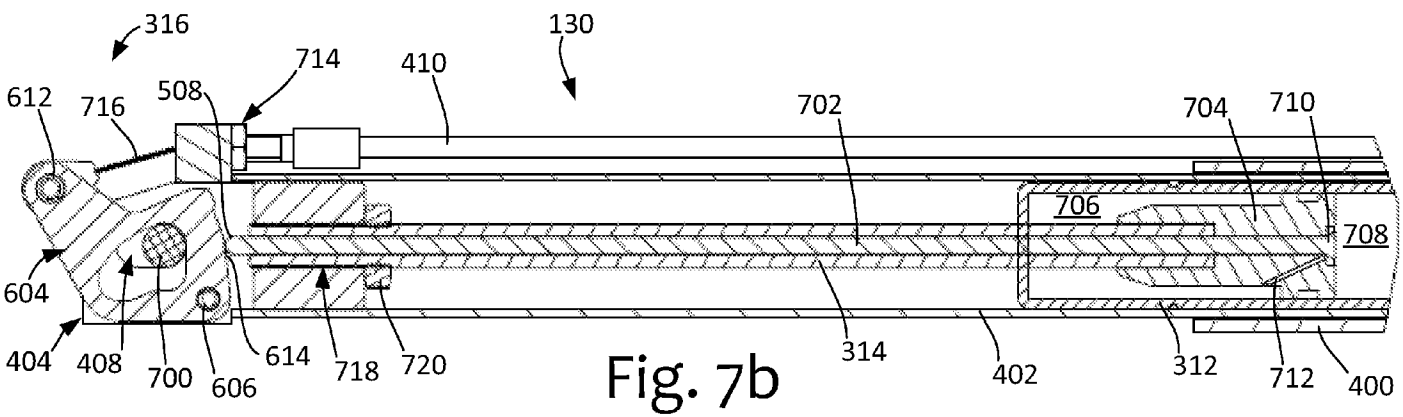
FIG. 7*b* is a cross-sectional view of components of the release and the lockable damper when the backrest is in the fully prone position.

FIG. 7*b* shows the state of the lockable damper 130 and the release mechanism 316 of the backrest actuator assembly 124 when the backrest 105 is in the fully prone position. The pin 700 that pin connects the release mechanism 316 to the lever arm 126 of the backrest support 122 (at 318 in FIG. 3) is free to take any position in the slot 408, since the actuator assembly 124 is unloaded. At this time, the specific position of the pin 700 in the slot 408 depends on the specific geometries involved, and is of little consequence. The specific position of the pin 700 may allow the contact surface 614 of the lever 604 to contact the rounded end 508 of the pin 702 that unlocks the lockable damper 130. Consequently, the lockable damper 130 may be locked, partially unlocked, or fully unlocked.

Also shown in FIG. 7*b* are internal components of the lockable damper 130. A piston 704 is slidably disposed inside the cylindrical body 312. On each side of the piston 704 there is a chamber of hydraulic fluid 706, 708 that can be selectively communicated by pushing the unlocking pin 702 that extends through the rod 314 to open a valve 710 in the piston 704 to allow hydraulic fluid to move between the chambers 706, 708 through a channel 712. Forcing the hydraulic fluid through the relatively narrow channel 712 causes a damping effect when the valve 710 is opened. The channel 712 can be sized to influence the damping effect. When the valve 710 is closed, the substantially incompressible hydraulic fluid cannot move between the chambers 706, 708, thereby locking the piston 704 and attached rod 314 relative to the cylinder 312. The lockable damper 130 can thus be fixedly locked at any point along its range of motion or stroke. In this example, the chamber 708 is under pressure from a neighboring chamber containing pressurized gas (not shown) to tend to urge the rod 314 to extend when the damper 130 is unlocked. The pin 702 and valve 710 are just one example of an unlocking mechanism for the damper 130.

As can also be seen, a threaded portion of the rod 314 of the lockable damper 130 is threaded into a hole 718 in the bearing block 404. A lock nut 720 is also threaded onto the threaded portion of the rod 314 and tightened against the bearing block 404 to lock the rod 314 to the bearing block 404.

FIG. 7*b* also shows the connection of the pull cables 410 (one shown) to the bearing block 404 and the lever 604. An end fitting of the pull cable 410 is threaded into a protrusion of the bearing block 404 at 714 to fix the sheath or conduit of the pull cable 410 to the bearing block 404. On the lever-side of the connection 714, the cable 716 of the pull cable 410 extends out of the sheath or conduit and has an end with an eyelet that is fixed to the hole 612 on the lever 604 using a bolt.

Figures 8A, 8B:
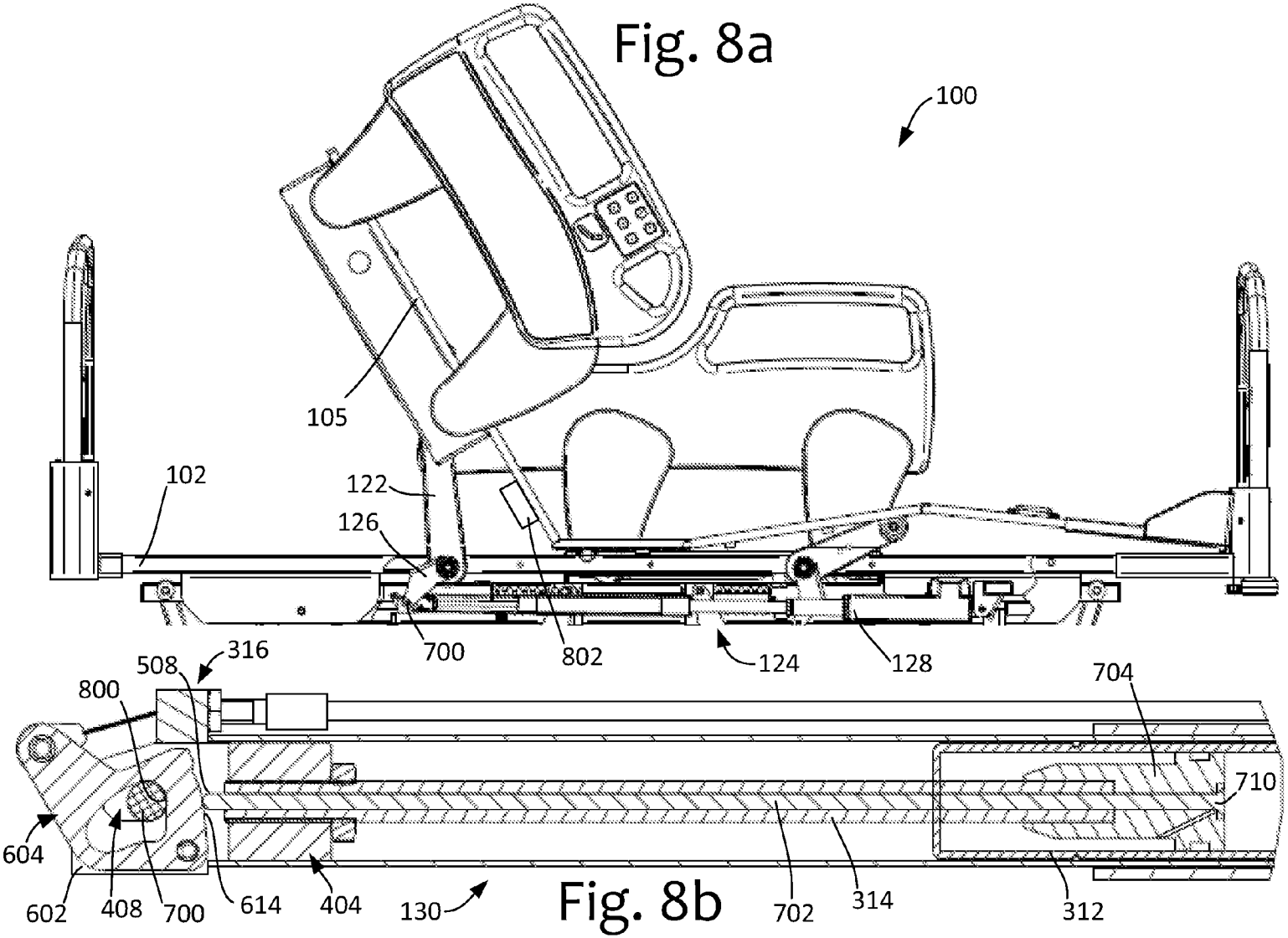
FIG. 8*a* is a side view of the bed when the backrest is in a raised position.
FIG. 8*b* is a cross-sectional view of components of the release and the lockable damper when the backrest is in the raised position.

FIG. 8*a* shows the backrest 105 of the bed 100 in the raised position, which the occupant of the bed 100 may use when sitting upright. A substantial amount of loading is taken by the backrest actuator assembly 124 in this position to keep the backrest 105 raised against its weight and forces applied by the occupant of the bed 100. The backrest 105 can be moved into this position from the position shown in FIG. 7*a* by extending the actuator 128 while keeping the lockable damper 130 locked. Also shown in FIG. 8*a* is a backrest tilt sensor 802 (such as an accelerometer or an inclinometer) attached to the backrest 105 for measuring the angle of the backrest 105 and providing a corresponding signal to the actuator controller 202. The raised position shown may be the fully raised position or any intermediate raised position between fully raised and prone.

FIG. 8*b* shows the state of the lockable damper 130 and the release mechanism 316 of the backrest actuator assembly 124 when the backrest 105 is in a raised position. Bearing surfaces 800 of the slots 408 of the legs 602 of the bearing block 404 abut the pin 700, which pushes against the lever arm 126 of the backrest support 122 to keep the backrest 105 raised against gravity. In FIG. 8*b*, the bearing surfaces 800 appear as a line coincident with a similar line of the lever 604, but it should be noted that the lever 604 does not experience any appreciable load from the pin 700 in this position. The backrest 105 is being held up by the pin 700 bearing against the bearing surfaces 800 of the bearing block 404. Although the end 508 of the unlocking pin 702 of the damper 130 may be touching the contact surface 614 of the lever 604, such contact is not enough to open the valve 710 of the piston 704 to allow the damper 130 to collapse. Accordingly, the lockable damper 130 remains locked.

With the lockable damper 130 remaining locked in a fully or partially extended configuration, the actuator 128 can be controlled to raise, lower, and stop the backrest 105 between the positions shown in FIGS. 7*a* and 8*a* as part of normal operation of the bed 100.

Figure 9A:
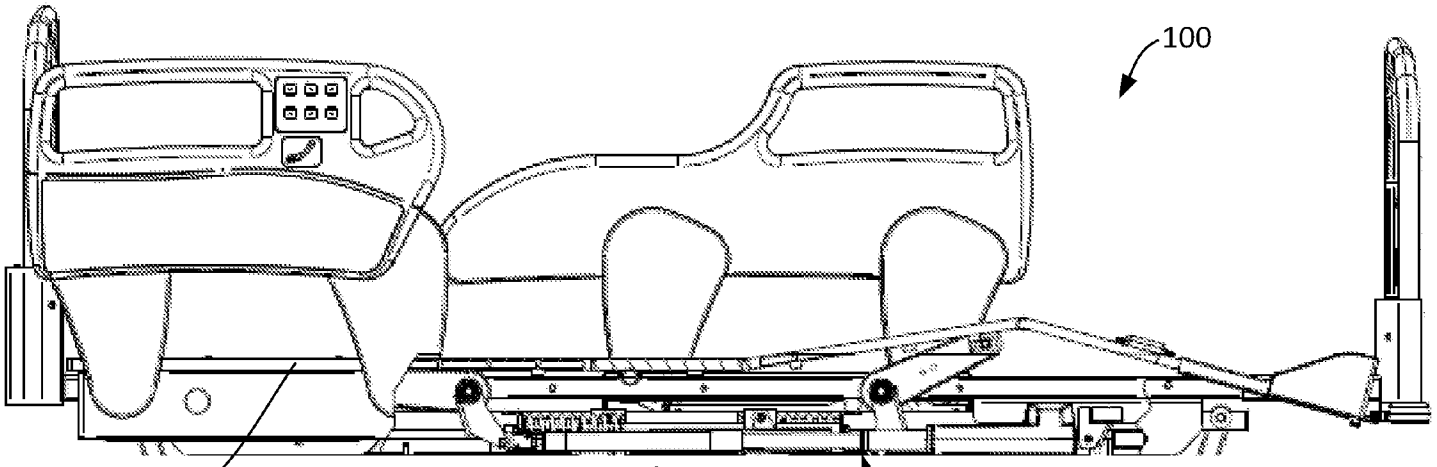
FIG. 9*a* is a side view of the bed at the end of an emergency lowering of the backrest.

FIG. 9*a* shows the backrest 105 of the bed 100 returned to the prone position, after the handle 200 has been pulled during an emergency. While the backrest 105 is lowering into the position shown, the release mechanism 316 and lockable damper 130 are in the states illustrated in FIG. 9*b*.

Figure 9B:
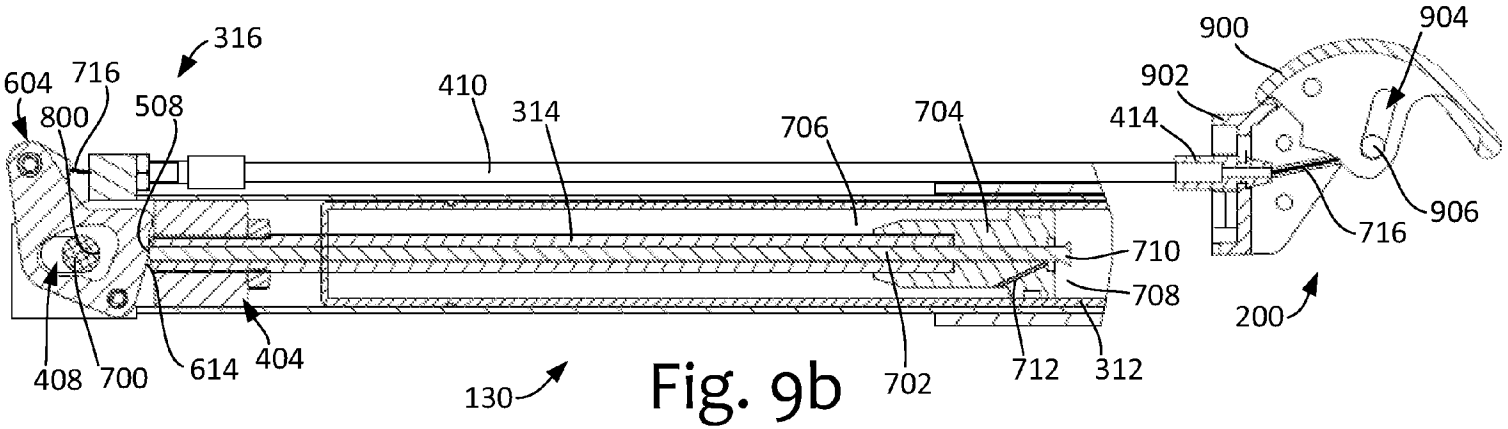
FIG. 9*b* is a cross-sectional view of components of the release and the lockable damper during an emergency lowering of the backrest.

As shown in FIG. 9*b*, to initiate an emergency lowering of the backrest 105 a moveable portion 900 of the release handle 200 is pulled by a nurse or attendant. In this example, the moveable portion 900 of the handle 200 is pivot connected to a base portion 902 that is fixed to the bed 100. The moveable portion 900 is shaped to be pulled by a person's hand and has a slot 904 that slidably engages a pin 906 fastened to the end of the cable 716. When the moveable portion 900 is pulled, the pin 906 abuts an end of the slot 904 to pull the cable 716 and thus pivot the lever 604 with respect to the bearing block 404.

When the lever 604 pivots in response to the moveable portion 900 of the handle 200 being pulled, the contact surface 614 pushes against the end 508 of the unlocking pin 702 to open the valve 710 and allow the piston 704 and attached rod 314 of the now unlocked damper 130 to move in a damped manner. Due to the weight of the backrest 105 and the load it carries, the damper 130 collapses to a shorter length, or more specifically, the damper rod 314 is pushed into the cylinder 312 as hydraulic fluid moves through the channel 712 from the chamber 708 to the chamber 706.

The motion of the backrest 105 during an emergency lowering happens in a controlled manner. During the lowering, the bearing block 404 supports the backrest 105 via the pin 700 abutting the surfaces 800, even as the bearing block 404 moves with the rod 314 of the collapsing damper 130. If the moveable portion 900 of the handle 200 were to be released, the lever 604 would return back to the position shown in FIG. 8*b* and the backrest 105 would stop. Being able to stop the lowering motion of the backrest 105 at any position can be useful when an object or person's appendage becomes stuck behind the lowering backrest 105. The object or appendage can be removed and the handle 200 can be pulled again to quickly resume the emergency lowering.

Figure 10A:
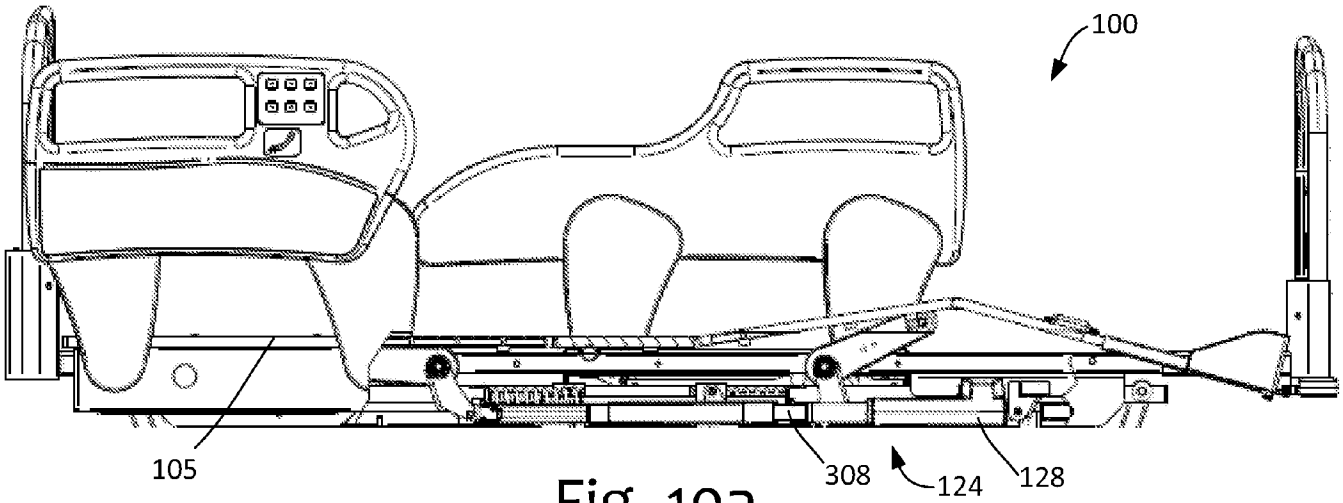
FIG. 10*a* is a side view of the bed during reset from an emergency lowering of the backrest.

FIG. 10*a* shows the backrest 105 of the bed 100 returned to the prone position, after the completion of an emergency lowering.

Figure 10B:
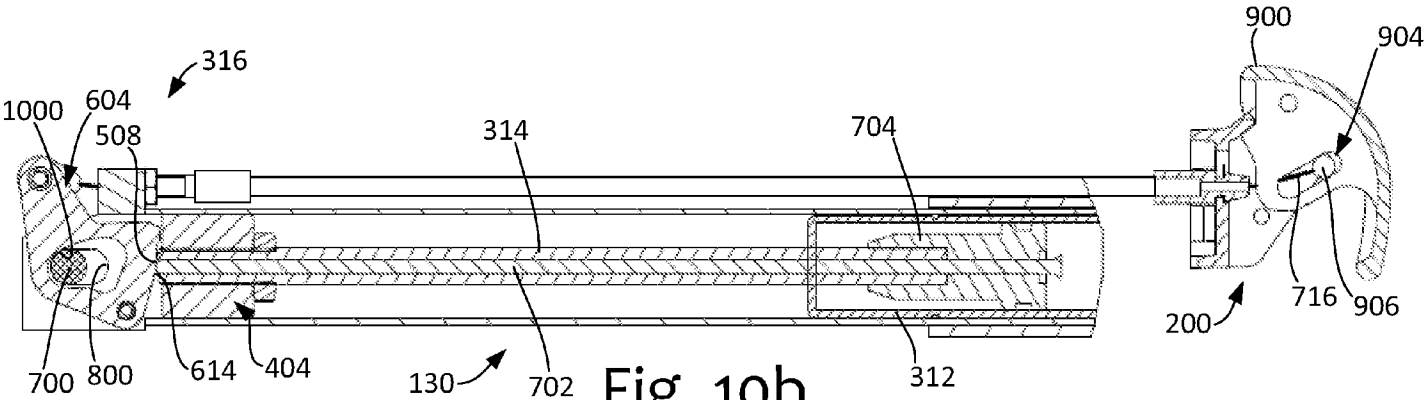
FIG. 10*b* is a cross-sectional view of components of the release and the lockable damper during reset from an emergency lowering of the backrest.

FIG. 10*b* shows the release mechanism 316 and lockable damper 130 while the backrest actuator assembly 124 is resetting from the emergency lowering. The backrest tilt sensor 802 can indicate to the actuator controller 202 that the backrest 105 has returned to the prone position, so that the actuator controller 202 can drive the actuator 128 to reset from the emergency lowering.

During reset, the actuator rod 308 is retracted. The lever 604 of the release mechanism 316 is configured to engage the unlocking mechanism of the lockable damper 130 in response to the actuator rod 308 being retracted, which causes the damper 130 to unlock and extend. Specifically, as the actuator rod 308 retracts, it pulls on the cylinder 312 of the damper 130. In response, and assuming the lockable damper 130 is locked, the cylinder 312 pulls on the rod 314 via the locked piston 704. The rod 314 pulls on the bearing block 404 which, since in this position the surfaces 800 experience little or no load from the pin 700, moves to bring the cam surface 1000 of the lever 604 into contact with the pin 700. The cam surface 1000 is shaped to contact the pin 700 to allow the pin 700 to move the lever 604 into engagement with the unlocking mechanism of the damper 130. That is, the force of the pin 700 on the cam surface 1000 causes the lever 604 to pivot to bring the contact surface 614 of the lever 604 into contact with the end 508 of the unlocking pin 702 of the damper 130. The damper 130 is unlocked and can thus extend until the actuator 128 has retracted to the position that normally corresponds to the prone position of the backrest 105 (see FIG. 7*a*). When the actuator 128 has fully retracted, the release mechanism 316 and lockable damper 130 are returned to the state shown in FIG. 7*b*.

FIG. 10*b* also shows that during reset of the actuator 128, the slot 904 and pin 906 arrangement at the movable portion 900 of the handle 200 can accommodate the excess length of the cable 716 due to the lever 604 being positioned to unlock the damper 130, when the movable portion 900 of the handle 200 is returned to the non-emergency position.

Figure 11:
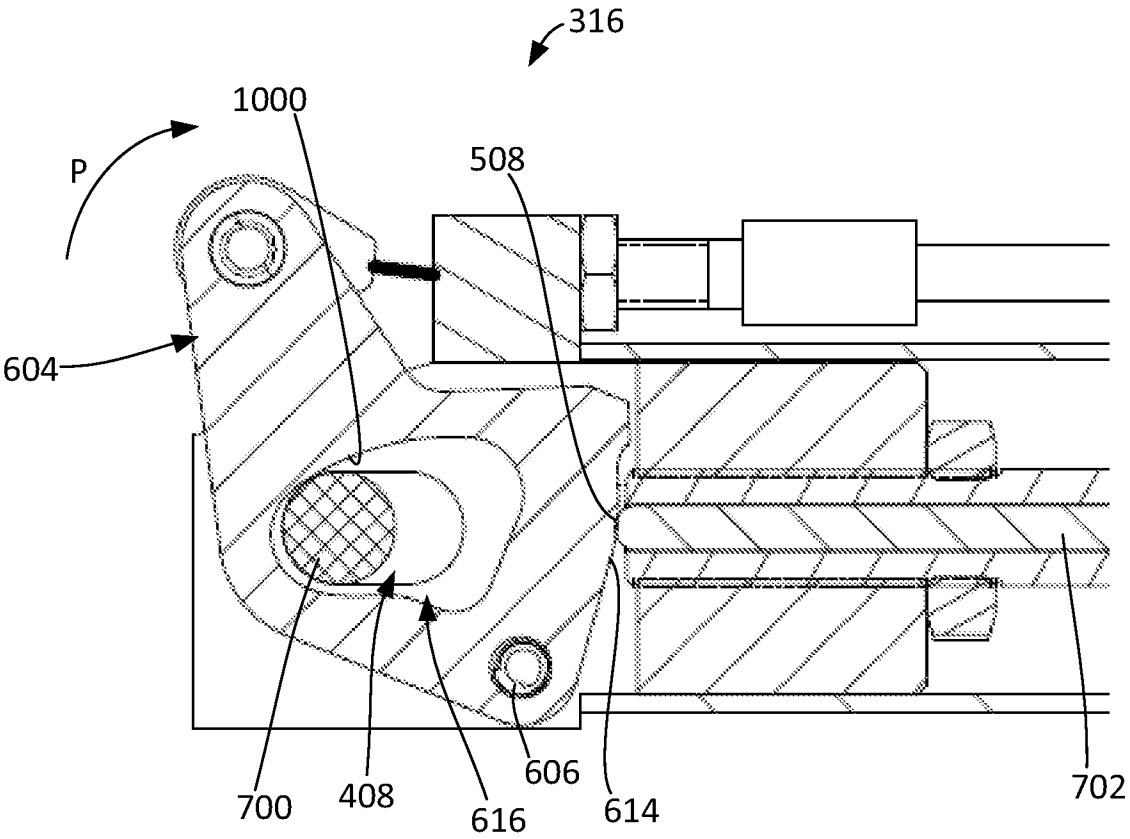
FIG. 11 is a cross-sectional view of the release mechanism.

FIG. 11 shows a close-up view of the release mechanism in detail. The opening 616 in the lever 604 is shaped to loosely accommodate the pin 700. During reset of the actuator 128, the cam surface 1000 of the opening 616 is in contact with the pin 700 and is pushed by the pin 700 when the pin 700 moves in the slot 408. The pin 700 pushing on the cam surface 1000 in this way causes the lever 604 to rotate (arrow P) about the pivot pin 606, so that the contact surface 614 pushes the end 508 of the unlocking pin 702 of the damper 130 to unlock the damper 130.

Figure 12:
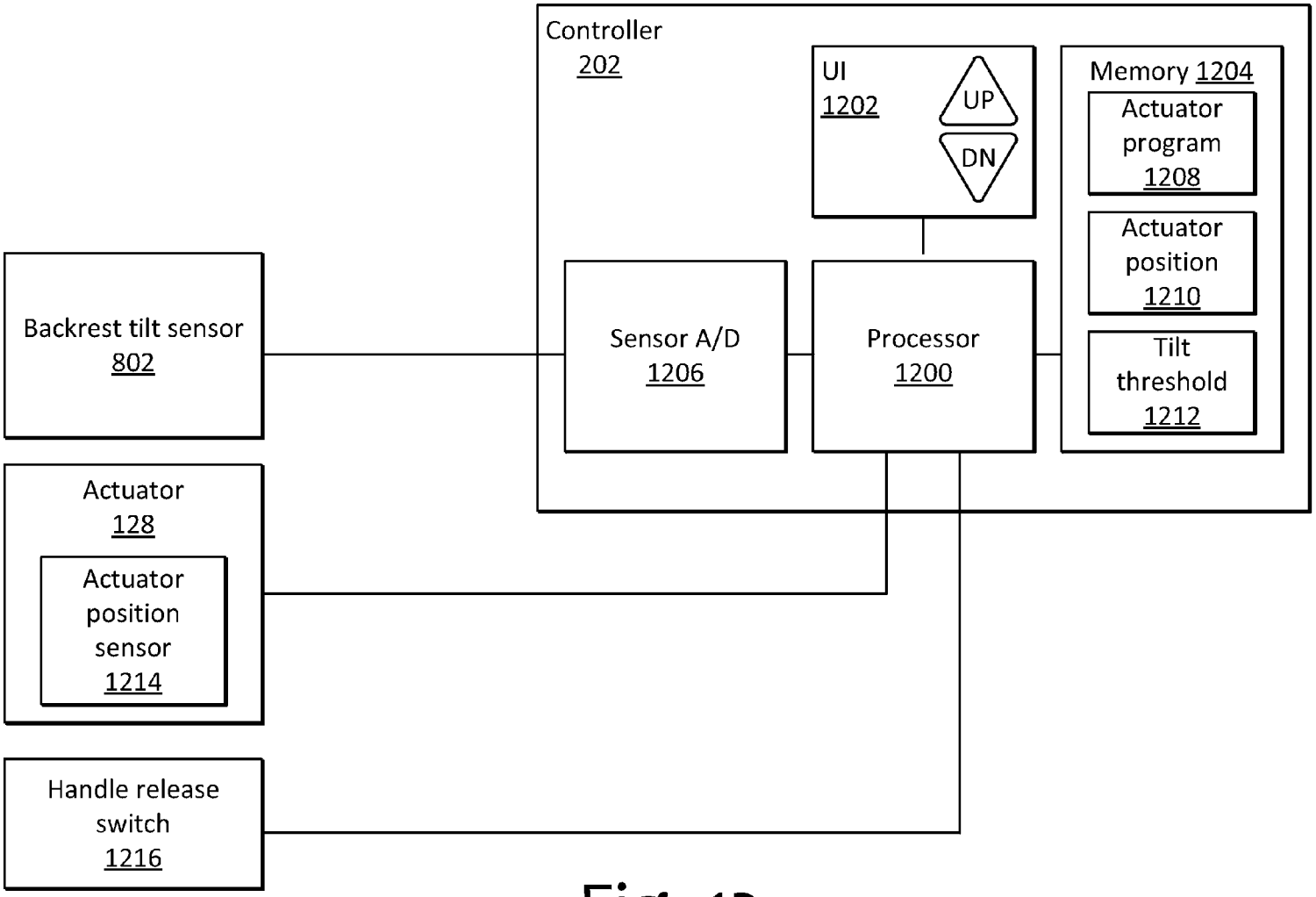
FIG. 12 is a functional block diagram of an actuator controller.

FIG. 12 shows the actuator controller 202. The controller 202 includes a processor 1200 connected to a user interface 1202, a memory 1204, and an analog-to-digital converter 1206 for the backrest tilt sensor 802.

The processor 1200 can be a microcontroller of the kind that is readily commercially available for controlling actuators and auxiliary devices.

The user interface 1202 can include buttons and a screen for controlling operation of the bed 100. For example, buttons can be provided to command the actuator 128 to raise and lower the backrest 105. Such buttons can include momentary contact switches, which may also be known as "hold-and-run" switches.

The memory 1204 can be a random-access memory (RAM), a read-only memory (ROM), or the like. The memory 1204 can store an actuator program 1208 that includes instructions for controlling the actuator 128 during normal operation as well as during emergency backrest lowering reset. The memory 1204 can also store an actuator position 1210 and a backrest tilt threshold 1212 that each correspond to the fully prone position of the backrest 105. In this example, the backrest tilt threshold 1212 is set to be 2 degrees above true horizontal.

A handle release switch 1216 can be provided to the handle 200 to determine when the handle has been pulled to initiate or continue an emergency lowering of the backrest 105. The handle release switch 1216 can be a conductive contact switch that closes or opens a circuit, a photosensor switch, or the like. The handle release switch 1216 can be electrically connected to the processor 1200 to provide a signal to the processor 1200 indicative of whether the handle 200 has been pulled or not.

The processor 1200 can thus detect the position of the handle release switch 1216 and also detect, via the backrest tilt sensor 802, when the backrest 105 has been lowered to the fully prone position. In response to this detection, the processor 1200 commands the actuator 128 to retract to the stored position 1210, as measured by the actuator position sensor 1214 (e.g., rotary pulse encoder), that corresponds to the fully prone position of the backrest 105. Thus, the controller 202 is configured to automatically reset the backrest actuator assembly 124 to its normal operative state by retracting the actuator 128 to a position corresponding to the prone position of the backrest 105 after the release 416 has unlocked the lockable damper 130 and when the backrest tilt sensor 802 determines that the backrest 105 has fully lowered into the prone position.

Figure 13:
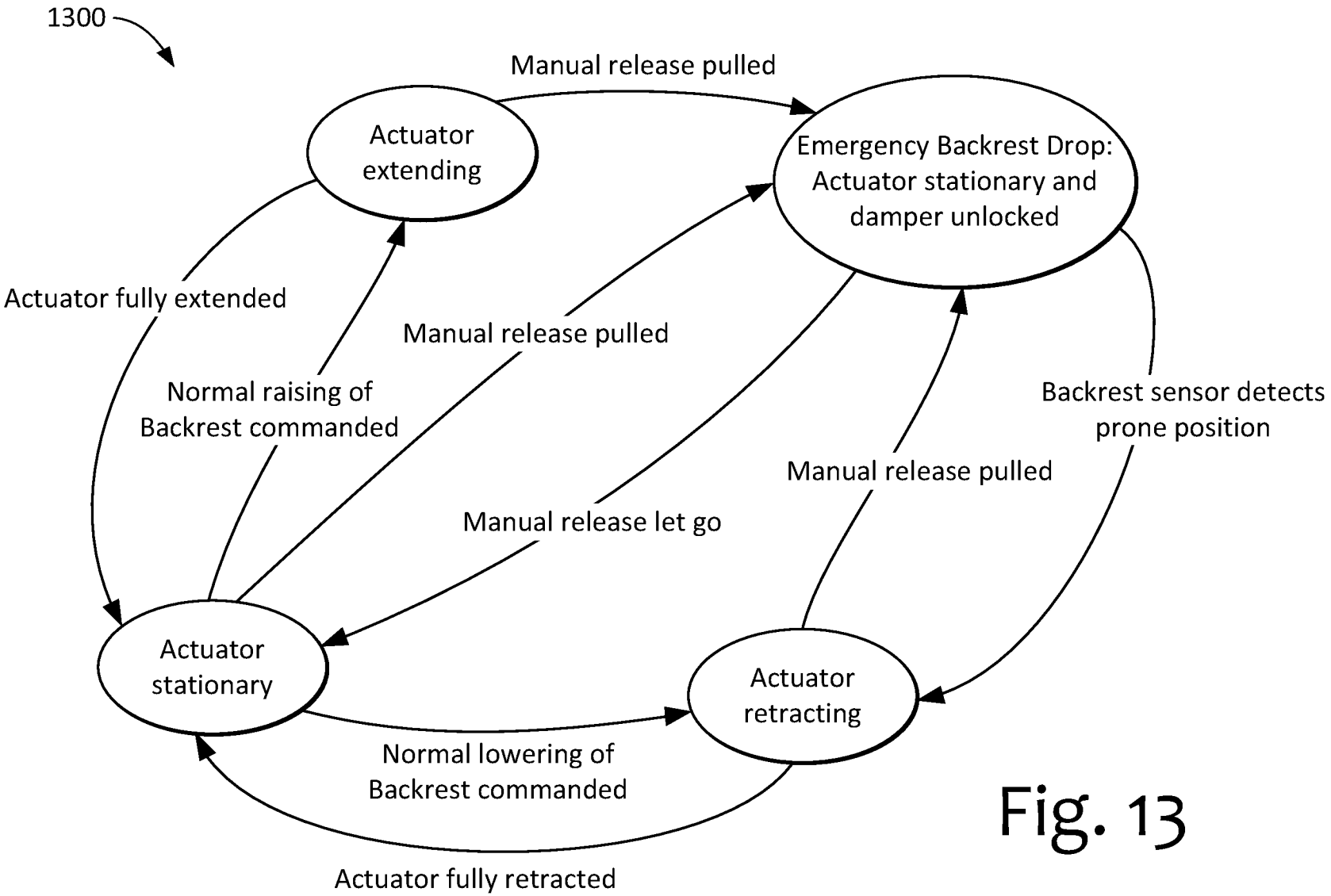
FIG. 13 is a state diagram of control and operation of the backrest actuator assembly.

FIG. 13 is a state diagram of operative states 1300 of the backrest actuator assembly 124. The operative states 1300 and the transition conditions between the operative states 1300 can be realized in the actuator program 1208.

In other examples, the positions of the lockable damper 130 and the actuator 128 can be swapped.

In still other examples, the lockable damper 130 can be normally unlocked, and then locked rigid by actuation of a locking mechanism, which is released during an emergency condition to allow the damper 130 to collapse.

Figure 14:
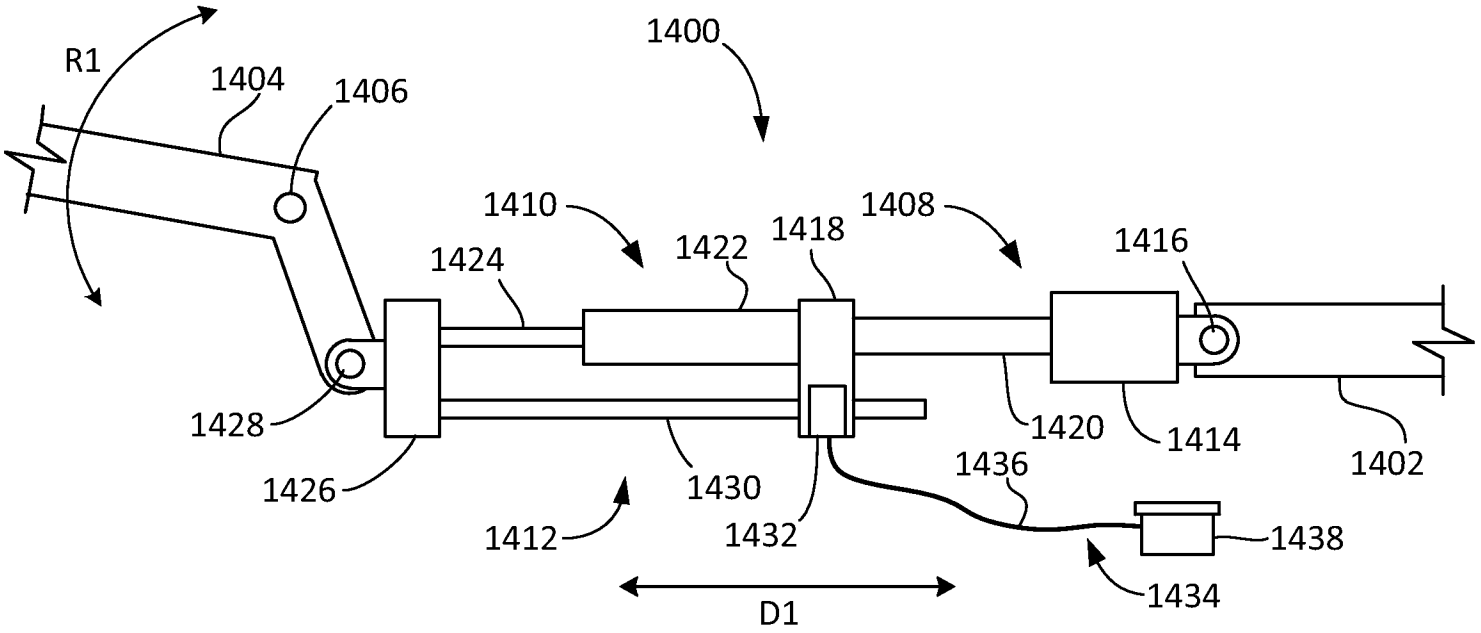
FIG. 14 is a side view of a portion of a patient support device having an actuator assembly with a damper and a separate locking structure.

FIG. 14 shows a portion of an apparatus equipped with an actuator assembly 1400 having a damper and separate locking structure. The actuator assembly 1400 is similar to the other actuator assemblies described herein. Differences between the actuator assembly 1400 and the other actuator assemblies described herein will be discussed in detail below with reference to the actuator assembly 1400 being connected to a patient support device, such as a bed, chair, or other support device; however, the actuator assembly 1400 can be used with other types of apparatus. For further description of features and aspects of the actuator assembly 1400, the description of the other actuator assemblies can be referenced. Features and aspects of the other actuator assemblies described herein can be used with the actuator assembly 1400.

The actuator assembly 1400 connects a first, fixed component 1402 of the patient support device to a second, movable component 1404 of the patient support device. In this example, the movable component 1404 is part of a rotating backrest that pivots about a pivot connection 1406 to a part (not shown) of the patient support device fixed with respect to the fixed component 1402, which can be part of the frame of the patient support device. As the actuator assembly 1400 extends and retracts parallel to arrow D1, the movable component 1404 rotates along arrow R1.

The actuator assembly 1400 includes an actuator 1408 and a damper 1410 connected series with the actuator 1408, and a lock 1412 connected in parallel to the damper 1410.

A housing 1414 of the actuator 1408 is pin connected at 1416 to the fixed component 1402 of the patient support device. A connector block 1418 connects an extendable and retractable rod 1420 of the actuator 1408 to the damper 1410.

The damper 1410 includes a cylinder 1422 and an extendable and retractable rod 1424 connected between the connector block 1418 and a bearing block 1426, which is pin connected at 1428 to the movable component 1404 of the patient support device.

In this example, the lock 1412 includes a rod 1430 fixed to the bearing block 1426 and a clamp 1432 at the connector block 1418. The rod 1430 slidably extends through the clamp 1432, and the clamp 1432 can be actuated to clamp or release the rod 1430 anywhere along the length of the rod 1430 to thereby respectively prevent or allow the damper 1410 to extend or retract. In this example, the clamp 1432 is biased to clamp the rod 1430 to lock movement of the damper 1410 and thereby fix the distance between the connector block 1418 and the bearing block 1426. The clamp 1432 can be actuated to unlock the rod 1430 by a release 1434 that includes a pull-cable 1436 connected to a manually operated handle 1438 located on the patient support device. Such release of the rod 1430 frees the damper 1410 to extend or retract, and thus allows damped relative movement of the bearing block 1426 with respect to the connector block 1418.

The rod 1430 and clamp 1432 are merely one example of how the lock 1412 is configured to lock the damper 1410 at any position along its range of motion when, for example, the position of the movable component 1404 is to be controlled by the actuator 1408. The damper 1420 can be thus locked during normal raising and lowering of the movable component 1404. Moreover, the damper 1410 is configured to provide damping over its range of motion when the lock 1412 is unlocked during, for example, an emergency lowering of the movable component 1404.

The lock 1412 is merely one example of a locking structure that is separate from the damper 1410 but that can lock the damper 1410 at any position along its range of motion. Other examples can also be used.

While the foregoing provides certain non-limiting example embodiments, it should be understood that combinations, subsets, and variations of the foregoing are contemplated. The monopoly sought is defined by the claims.

What is claimed is:

1. A bed comprising:

a bed frame;

a backrest pivotable with respect to the bed frame;

a backrest actuator assembly directly connecting the backrest to the bed frame, the backrest actuator assembly configured to raise and lower the backrest with respect to the bed frame, the backrest actuator assembly having an actuator having a first end and a second end, the first end connected to the bed frame, a lockable damper connected in series with the actuator, the lockable damper having a first end and a second end, the first end of the lockable damper connected to the second end of the actuator, the lockable damper configured to have a first fixed length when locked, the lockable damper further configured to provide damping over a variable length range of motion when unlocked and to be lockable at a position on the range of motion to attain a second fixed length, the second fixed length being shorter than the first fixed length;

a release connected to the lockable damper and the backrest, the release configured to unlock the lockable damper; and an emergency release handle operably connected to the release and configured to unlock the lockable damper when the emergency release handle is actuated, allowing the lockable damper to contract and initiate emergency lowering of the backrest, wherein during emergency lowering, the backrest rotates under the force of gravity and without operating the actuator, wherein rotation of the backrest during emergency lowering is limited by damping of the lockable damper.

2. The bed of claim 1, wherein the lockable damper is configured to lock at any position along the range of motion.

3. The bed of claim 1, wherein the release comprises a lever positioned to engage an unlocking mechanism of the lockable damper.

4. The bed of claim 3, wherein the lever is configured to engage the unlocking mechanism of the lockable damper when the release is in the unlock position.

5. The bed of claim 4, wherein the lever has a cam surface that engages a pin connected to the backrest.

6. The bed of claim 5, wherein the lever is pivot-connected to the backrest actuator assembly, and the cam surface is shaped to contact the pin to move the lever into engagement with the unlocking mechanism of the damper in response to the actuator being retracted.

7. The bed of claim 1, wherein the lockable damper is linearly positioned between the actuator and the release.

8. The bed of claim 1, wherein the release is further configured to lock the lockable damper when the release is in a lock position.

9. The bed of claim 1, further comprising:

a backrest sensor positioned to determine when the backrest is in a prone position; and a controller coupled to the backrest sensor and the actuator, the controller configured to retract the actuator to a position corresponding to the prone position of the backrest after the release has unlocked the lockable damper and when the backrest sensor determines that the backrest is in the prone position.

10. The bed of claim 9, wherein the backrest sensor comprises a backrest tilt sensor comprising an accelerometer or an inclinometer.

11. The bed of claim 1, wherein releasing the emergency release handle locks the lockable damper at its current position on the range of motion and stops rotation of the backrest.

12. The bed of claim 1, wherein the backrest is pivotable with respect to the bed frame at a pivot point that is fixed relative to the bed frame.

13. The bed of claim 1, wherein the backrest actuator assembly is attached to the bed frame.

14. A bed comprising:

a bed frame;

a backrest pivotable with respect to the bed frame; and a backrest actuator assembly directly connecting the backrest to the bed frame, the backrest actuator assembly configured to raise and lower the backrest with respect to the bed frame, the backrest actuator assembly further configured to release the backrest to lower due to gravity over a damped range of motion, the backrest actuator assembly further configured to stop the lowering of the backrest at any position along the damped range of motion, wherein the backrest actuator assembly comprises:

an actuator having a first end and a second end, the first end connected to the bed frame;

a lockable damper connected in series with the actuator, the lockable damper having a first end and a second end, the first end of the lockable damper connected to the second end of the actuator, the second end of the lockable damper operably connected to the backrest, the lockable damper configured to have a first fixed length when locked and to be lockable at a position on the range of motion to attain a second fixed length, the first fixed length providing damping over a variable length range of motion when unlocked, the second fixed length being shorter than the first fixed length; and an emergency release handle configured to unlock the lockable damper when the emergency release handle is actuated, allowing the lockable damper to contract and initiate emergency lowering of the backrest, wherein during emergency lowering, the backrest rotates under the force of gravity and without operating the actuator, wherein rotation of the backrest during emergency lowering is limited by damping of the lockable damper.

15. The bed of claim 14, wherein the actuator is an electric actuator.

16. The bed of claim 14, wherein the lockable damper is a locking hydraulic damper or a locking gas spring.

17. The bed of claim 14, further comprising a release connected between the lockable damper and the backrest, the release configured to unlock the lockable damper.

18. The bed of claim 17, wherein the lockable damper is linearly positioned between the actuator and the release.

19. The bed of claim 14, further comprising:

a backrest sensor positioned to determine when the backrest is in a prone position; and a controller coupled to the backrest sensor and the backrest actuator assembly, the controller configured to reset the backrest actuator assembly to a position corresponding to the prone position after the backrest sensor determines that the backrest has lowered due to gravity into the prone position.

20. The bed of claim 19, wherein during reset, the actuator retracts, causing the lockable damper to unlock and extend to its first fixed length.

21. The bed of claim 14, wherein releasing the emergency release handle locks the lockable damper at its current position on the range of motion and stops rotation of the backrest.

22. The bed of claim 14, wherein the backrest is pivotable with respect to the bed frame at a pivot point that is fixed relative to the bed frame.

23. The bed of claim 14, wherein the backrest actuator assembly is attached to the bed frame.

* * * * *